US007172205B1

(12) United States Patent
Vujtech

(10) Patent No.: US 7,172,205 B1
(45) Date of Patent: Feb. 6, 2007

(54) TWO-WHEELED RIDING-BOARD APPARATUS

(76) Inventor: James A. Vujtech, 6508 Fitch Rd., Olmsted Township, OH (US) 44838

( * ) Notice: Subject to any disclaimer, the term of this patent is extended or adjusted under 35 U.S.C. 154(b) by 293 days.

(21) Appl. No.: 10/855,746

(22) Filed: May 28, 2004

(51) Int. Cl.
*B62M 1/00* (2006.01)

(52) U.S. Cl. ..... 280/87.021; 280/87.042

(58) Field of Classification Search ..... 280/87.01, 280/87.021, 87.03, 87.041, 87.042, 842, 280/843, 11.204, 11.211, 11.214
See application file for complete search history.

(56) References Cited

U.S. PATENT DOCUMENTS

| | | | | | |
|---|---|---|---|---|---|
| 1,123,686 | A * | 1/1915 | Cole et al. | ..... | 280/87.042 |
| 1,147,566 | A * | 7/1915 | Taylor | ..... | 280/87.041 |
| 3,767,220 | A * | 10/1973 | Peterson | ..... | 280/842 |
| 3,856,321 | A * | 12/1974 | Solymosi | ..... | 280/87.041 |
| 4,021,052 | A * | 5/1977 | Knowles | ..... | 280/842 |
| 4,050,705 | A * | 9/1977 | Kreis | ..... | 280/842 |
| 4,323,258 | A * | 4/1982 | Culpeper | ..... | 280/7.12 |
| 4,744,576 | A * | 5/1988 | Scollan, Jr. | ..... | 280/87.042 |
| 4,887,824 | A * | 12/1989 | Zatlin | ..... | 280/87.042 |
| 4,943,072 | A * | 7/1990 | Henig | ..... | 280/11.215 |
| 4,991,861 | A * | 2/1991 | Carn et al. | ..... | 280/87.042 |
| 5,160,155 | A * | 11/1992 | Barachet | ..... | 280/87.042 |
| 5,169,165 | A * | 12/1992 | Oates | ..... | 280/87.03 |
| 5,354,081 | A * | 10/1994 | Huffman et al. | ..... | 280/87.01 |
| 5,833,252 | A * | 11/1998 | Strand | ..... | 280/87.042 |
| 5,855,385 | A | 1/1999 | Hambsch | ..... | 280/87.042 |
| 6,296,082 | B1 * | 10/2001 | Tsai | ..... | 188/19 |
| 6,338,494 | B1 | 1/2002 | Killian | ..... | 280/87.042 |
| 6,398,237 | B1 * | 6/2002 | Attey | ..... | 280/87.042 |
| 6,672,602 | B2 | 1/2004 | Way, II et al. | ..... | 280/87.01 |
| 6,808,187 | B1 * | 10/2004 | Harris | ..... | 280/87.01 |
| 7,000,930 | B2 * | 2/2006 | Smith | ..... | 280/87.021 |
| 2002/0105158 | A1 * | 8/2002 | Stewart et al. | | |
| 2003/0164269 | A1 * | 9/2003 | Attey | | |

FOREIGN PATENT DOCUMENTS

| | | | |
|---|---|---|---|
| EP | 620031 | A1 * | 10/1994 |
| FR | 2607713 | A1 * | 6/1988 |
| WO | WO 89/02301 | * | 3/1989 |

* cited by examiner

*Primary Examiner*—Christopher Bottorff
(74) *Attorney, Agent, or Firm*—Joseph H. Taddeo

(57) ABSTRACT

This novel all-terrain, two-wheeled, riding-board provides a safe operating sport-ride to the user. Two large diameter wheels, one fore and one aft, are provided to improve the safety of this novel riding-board. Each wheel has a resilient elastomeric pneumatic tire mounted on each rim. A dual set of smaller stabilizer wheels are mounted outwardly at the rear of the deck to limit the travel and prevent tipping over. The outboard repositionable stabilizer wheels also serve to function as maneuvering devices, where the rider, by shifting his body weight over one of the stabilizing wheels, can decisively change the direction of his descent, either to the left or to the right. A dual foot operated braking system is provided where the brake on each wheel is individually operated.

15 Claims, 3 Drawing Sheets

TWO-WHEELED RIDING-BOARD APPARATUS

FIELD OF INVENTION

The present invention relates primarily to a novel all-terrain, riding-board device, used for recreational and athletic purposes, and more particularly to a two-wheeled, riding-board apparatus that performs stably in all-terrains, and simulates on land, the motion and ride obtained on a skateboard, a snowboard or even a surfboard.

BACKGROUND OF THE INVENTION

There are three related recreational sporting events that appeal initially to a small group of surfers, backcountry enthusiasts, and skateboarders, for year-round participation and enjoyment. In the aquatic sporting events, a surfboard is used, whereas in summer land sporting events, skateboards are used, and in the winter season, the snowboards are primarily used.

The modern surfboards are large boards constructed of a plastic foam core that is shaped by machine or hand-shaped, and covered with a thin shell of fiberglass and resin. Surfboard dimensions vary widely and are governed by the needs of the enthusiast. High performance surfboards used by the top professionals vary typically from about 1.8 to 2 meters (6 ft.) in length and about 47 cm. (18.5 in.) in width; weighing about 2.7 kg (6 lbs.) and less than 6 cm. (2.5 in) thick. This style of board is also known as a "shortboard."

On the other end of the surfboard spectrum is the "longboard," where most longboards are 2.7 m. (9 ft.) long, 51 to 56 cm. (20 to 22 in.) wide, weighing less than 7 kg (15 lb and about the same thickness as the shortboard. The bottom of this board has from one to five fins near the tail, where the three-fin, thruster design is considered to be standard. These fins provide the board with directional stability and enhance performance by providing additional power and forward drive. Either style board can be used in recreational or in professional contexts, however, the shortboard performs better for speed and aerial maneuvers.

Snowboarding, on the other hand, is a sport often described as "surfing on snow." Snowboarders descend a slope by standing sideways on a lightweight board about 150 cm (about 5 ft) long, attached to their feet.

With snowboarding, the board lengths vary according to the size of the rider and the type of riding the rider does. Adult sized snowboards range from about 140 cm. to 180 cm. (about 4 ft. 7 in. to 5 ft. 11 in.). "Freestyle boards" are shortest, for easy maneuverability, whereas, the "freeride boards" are medium in length. "Carving boards" are still longer, so that can perform best at higher speeds. The longest are the "Alpine race boards" that may be as long as 190 cm. (6 ft 3 in.). These boards utilize a variety of bindings to hold the boots to the board, including metal fasteners, plastic straps, and step-in versions. Bindings having high backs behind the heels provide support and added leverage on turns.

Unlike skiers, who shift their weight from one ski to the other, snowboarders shift their weight from heels (heelside) to toes as well as from one end of the board to the other. When snowboarders shift their weight toward the nose (front of the board), the board heads downhill. When snowboarders shift their weight toward the tail (back of the board), they head uphill or slow down. Riders achieve quick turns by pushing the back foot forward or pulling it backward to change direction. They stop the board's motion by pushing heels or toes down hard to dig the edge of the snowboard into the snow.

Most winter resorts now have special areas for snowboarding known as halfpipes—a long, deep trench dug in the snow and shaped like a pipe cut in half along its length, where riders "drop in" the pipe, using the walls of the trench to launch themselves into the air and perform a variety of jumps and spins. Tricks range from riding backwards, called riding fakie, to spectacular spins and flips performed in the halfpipe.

Skateboarding is an athletic activity that involves riding on a specially designed four-wheeled wooden board. The enthusiast most generally rides skateboards on the pavement or any other surface that gives a relatively smooth ride. Originally, the sport was known as "sidewalk surfing" but soon established its own identity.

The earliest skateboards first appeared in the 1940s and 1950s, where many of the early boards were toy scooters whose handlebars had been removed. Other homemade skateboards were steel-wheeled roller skates nailed onto a piece of wood. The first commercially produced skateboards appeared in the early 1960s, when Makaha Skateboards established a successful business.

By the 1970s, skateboard design had advanced, and the models produced were much safer than those of earlier years. This was because companies were making wheels, trucks, and other parts specially designed for skateboards. For many years skateboard construction varied among manufacturers, as plastic, fiberglass, metal, and wood were tested as deck materials, but by the late 1970s wood had won out as the optimum material. Decks constructed of seven-ply laminated wood tended to be lighter and stronger than those made of other materials.

Skateboarding became a competitive sport when curved plywood ramps were designed for use in skateboarding—these ramps were first used in 1975 in Melbourne Beach, Fla.

A skateboard is comprised of four wheels attached to two axles called trucks that are mounted to the bottom of a wooden board called a deck. These decks are typically 79 cm. (31 in.) in length and about 20 cm. (8 in.) in width. Generally, seven layers of Canadian maple veneer, pressed and glued together, comprise the deck. To improve the strength and prevent the deck from splitting along the grain, the skateboard manufacturers alternate the direction of the wood grain of each layer. These decks feature a curved rise at each end—the front end is called a kicknose, and the one in the rear is called a kicktail. To perform the tricks and stunts, the skateboarders use the leverage from the kicked ends. An abrasive grip tape is normally used on the top surface to provide traction and prevent the rider from slipping off.

The trucks are most commonly mounted 33 to 38 cm. (13 to 15 in.) apart. They consist of a base plate that mounts to the deck with screws and a hanger that houses the axle. The wheels attach to each end of the axle. Most trucks are made of lightweight aluminum and allow a slight movement between the base plate and hanger. This flexibility allows riders to turn the skateboard by shifting their weight.

Skateboard wheels are made of a durable material called urethane. Standard wheels are 50 to 65 mm. 0.9 to 2.5 in. in diameter and 65 mm.(2.5 in. wide. Each wheel houses two sealed or shielded precision bearings. Protective equipment worn by skateboarders typically includes kneepads, elbow pads, wrist guards, gloves, and a helmet. The wearing of protective equipment is extremely important, especially for beginning riders.

The following prior art discloses the various aspects in the design and use of riding board apparatuses.

U.S. Pat. No. 5,855,385, granted Jan. 5, 1999, to S. G. Hambsch, discloses a wheeled board apparatus having a platform with concave sidecuts, where the wheeled board apparatus has a platform with first and second concave portions. At least two primary wheels are located along a central longitudinal axis, with at least three outrigger wheels located generally along each concave sidecut.

U.S. Pat. No. 6,338,494, granted Jan. 15, 2002, to M. Fillian, discloses a two wheel articulated board device which the user can operate on smooth rough or smooth terrain. The device has a rear board member and a front board member, which are connected at a pivot point. Each board member can rotate relative to the other board member around this pivot point. The device is supported by two wheels. A rear wheel, which extends rear of the board and above the level of the board and a front wheel, which extends forward of the board and above the level of the board. The front wheel is connected to the board by a front fork which attaches to the underside of the board. The rear wheel is connected to the board by a rear fork which attaches to the underside of the board. There is a flexible member that connects at one end with the underside of the device rear of the pivot point and at the other end at the underside of the device forward of the pivot point. The user motions the board forward by placing one foot on the rear board member with that foot oriented about 45 degrees off the major axis of the device. Forward motion is achieved by the user pushing against the ground with his/her other foot. Once the user has gained enough speed and begins coasting, the user repositions his/her feet perpendicular to the long axis of the device. While coasting the user can affect a change of direction by changing the relative orientation of his/her feet which arc initially parallel without lifting them off the device. Moving the user's feet by bringing his/her toes closer together causes the rear board member to move relative to the front board member around the pivot point and thus affects a change of direction of the device. A flexible member running under the device along the major axis of the device and connected at one end to the rear board member and at the other end to the front board member applies a force to keep each board member aligned along their respective major axes.

U.S. Pat. No. 6,672,602, granted Jan. 6, 2004, to F. L. Way, II, et al., discloses a gravity driven steerable vehicle having wheels, or skis or a combination of wheels and skis for recreational use, most particularly on surfaces such as pavement, artificial hardpack turf, mountain slopes, dirt roads, grass and hard-packed or non-packed snow. The vehicle has at least three (3) but preferably four (4) wheels, or skis or a combination of wheels and skis which may or may not be on independent axles one from the other and which may or may not be each independently shock suspended. There is also a steering mechanism for steering the vehicle and a driver compartment portion for containing a driver of the vehicle in a prone face-down and face-forward position. The vehicle is steerable by the driver from the prone face-down and faceforward position. The mechanism for suspension of the wheels and/or skis is configured to provide precise control in turns especially the carving of turns, by the skis, while descending on snow covered terrain. The attitude of the skis relative to the snow surface changes upon initiation of a turn and while in the turn to increase the edging of the skis thereby enhancing the turning characteristics of the vehicle. The vehicle may further have a braking system for slowing or stopping the vehicle and a harness apparatus for harnessing the driver onto and into the vehicle.

What is needed is a safe, two-wheeled "riding-board," having an outboard set of repositionable stabilizer wheels to limit a leaning excursion, and having a controllable, individually foot operated, dual actuatable braking system. In this regard, the present invention fulfils this need.

It is therefore an object of the present invention to provide for a two-wheeled "riding-board," having a set of outboard stabilizer wheels to limit a leaning excursion.

It is another object of the present invention to provide for a two-wheeled "riding-board," having a set of outboard stabilizer wheels to control the downward direction by the rider shifting his weight over the appropriate outboard wheel to attain the desired direction.

It is another object of the present invention to provide for a two-wheeled "riding-board," having a set of outboard stabilizer wheels that are obliquely angled forward, where the rider use a side wheel to kick or immediately pivot the board for turning to that side.

It is still another object of the present invention to provide for a two-wheeled "riding-board," having a set of outboard stabilizer wheels that are parallel to the length of the board (the axel is orthogonal to the board) for downhill riding on a severe downgrade hill or when the rider is confronted by a hill that includes various undulations or irregularities.

It is still yet another object of the present invention to provide for a two-wheeled "riding-board," having a set of outboard stabilizer wheels that are angled toward the rear of the board to provide more speed for downhill racing, such as in instances where the rider does not anticipate doing much turning.

It is a final object of the present invention to provide a controllable, individually foot operated, dual actuatable, braking system. These objectives and other objects of the invention can be accomplished by providing:

A riding-board with a deck having head and tail sections, a longitudinal slot in each section with two wheel support brackets mounted oppositely in each side of the slots. The riding-board includes an axel in a spoke wheel with a rim having an elastomeric pneumatic tire mounted on the rim. The wheel axially secured on the support brackets of each slot.

The deck further includes symmetric longitudinal sidecuts that provide concave narrowed portions near a center of the deck with a consequent increased flexibility of the board. A pair of stabilizers are mounted on the deck near the tail section and project radially outward from each side the deck. Each stabilizer has a stabilizing bracket and a canted stabilizing wheel is mounted on an end of its respective bracket.

In addition, each stabilizer bracket is secured on its proximal portion to an underside of the deck and includes a downwardly curved radial end portion having an enlarged mounting hole that receives a resilient rubber bushing which surrounds a cap screw to attache each canted stabilizing wheel to the bracket. Upon rotation by intermittent contact with an underlying surface, the the canted wheel perturbates in an infinite variation in its rotation about a longitudinal axis through a center of the bushing.

A better understanding of these and other objects and advantages of the present invention will be best understood from the following description of the specific embodiments when read and understood in connection with the accompanying drawings.

SUMMARY OF THE INVENTION

The present invention relates to a novel two-wheeled riding-board that when in use provides a safe operating sport-ride to the user. To improve the safety of this novel riding-board, two large diameter wheels, one fore and the other, aft, are provided. Each wheel has a resilient elastomerically formulated, cushioned tire, mounted on each rim. A dual set of smaller stabilizer wheels are mounted outward at the rear of the deck to prevent tipping over by limiting the travel when a leaning excursion is encountered, thereby providing safe operation.

The outboard repositionable stabilizer wheels also serve to function as maneuvering devices, where the rider, by shifting his body weight over one of the stabilizing wheels, can decisively change the direction of his descent, either to the left or to the right.

A foot operated dual actuatable braking system is provided where the brakes on each wheel are individually operated—the front wheel may be operated independently by simply rotating ones right foot in a clockwise direction to apply the braking action to the front wheel, as needed. Conversely, the rear wheel may also be operated independently by simply rotating ones left foot in a counterclockwise direction to apply braking action to the rear wheel, again, as required.

Riding a board takes skill, stamina, and agility; riders should be in excellent physical condition. An experienced rider can descend rapidly in all terrains without having the riding-board wobble from the deleterious effects of the wind. The rider has full control over the course traveled, including the change of direction, or the speed of descent.

In competition, a rider can ride downward using one of several basic moves. In the bottom turn, a rider can turn the riding-board sharply by shifting his weight towards one of the outboard wheels, using momentum and speed gathered from the descent to redirect the riding-board up the face of the terrain.

Maneuvers in the air, known as aerials, have gained popularity with a younger generation of surfers, inspired by the moves of skateboarding and snowboarding, while competing on a smooth surface. In an aerial called a 360, for example, a surfer completes a 360-degree spin while airborne.

BRIEF DESCRIPTION OF THE DRAWINGS

The figures shown in the accompanying drawings are described briefly as follows.

Figure 1:
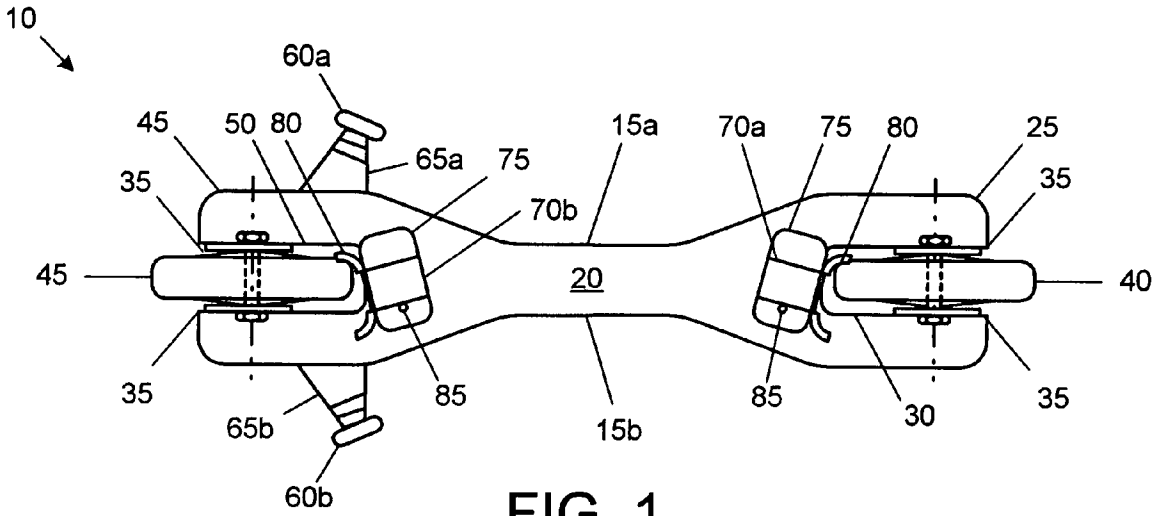
FIG. 1 is a top elevational view of the preferred embodiment of the two-wheeled riding-board.
Figure 2:
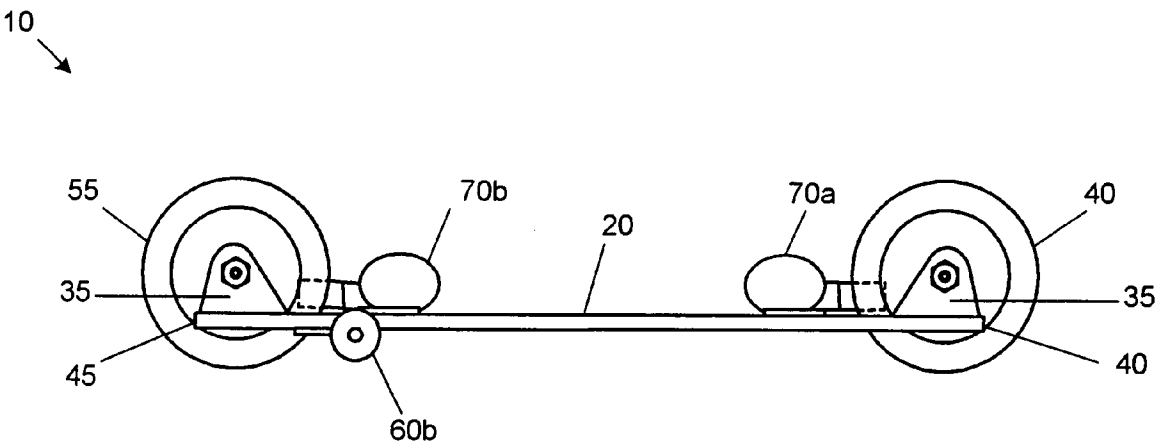
FIG. 2 is a top view of the preferred embodiment of the present invention, showing the outboard stabilizer wheels, positioned obliquely forward and canted outwardly.

A better understanding and appreciation of the present invention will be obtained upon reading the following detailed description of the present invention.

DETAILED DESCRIPTION OF THE INVENTION

There is shown in FIGS. 1 through 4, the all-terrain riding-board 10 of the present invention. This novel style of board can provide for an all-terrain sports activity, such as, on grass, dirt, snow or asphalt.

The deck 20 is manufactured using a deck material made of seven-ply laminated plywood. This type of fabrication tends to be lighter and stronger than those made of other materials. For the preservation of the plywood and appearance of the deck, a coating of poly-urethane is applied over the entire surface.

The longitudinal sides are sidecut symmetrically resulting in the concave narrowed portions 15*a* and 15*b* near of center of the deck, thereby adding flexibility of the board while reducing the weithe deck 20.

The front or head section 25 of the deck 20 has longitudinal slot 30 to which are rigidly mounted two wheel support brackets 35, located oppositely on each side of the front wheel cutout 30. A front wheel 40, with axel 33, is preferably comprised of a spoked wheel and rim, has a 12-inch diameter elastomeric pneumatic tire mounted on it, and is axially secured between the two brackets 35.

In a similar manner, the rear or tail 45 of the deck 20 also has longitudinal slot 50, to which are rigidly mounted two wheel support brackets 35, located oppositely on each side of the tail wheel cutout or slot 50. The rear wheel 55, having axel 53, is comprised of preferably a spoked wheel and rim that has a 12-inch diameter elastomeric pneumatic tire mounted on it, and is axially secured between the two brackets 35.

Toward the rear or tail section of the two-wheeled riding-board are protruding two stabilizing wheels 60*a* and 60*b*, where each is mounted on its respective stabilizing bracket 65*a* and 65*b*. The stabilizing brackets 65*a* and 65*b* are mounted and positioned in an obliquely forward facing manner, with the stabilizing wheels 60*a* and 60*b*, canted or tilted outwardly.

The outboard repositionable stabilizer wheels serve to function in keeping the board and rider from tipping over, and also serve to function as maneuvering devices, where the rider, by shifting his body weight over one of the stabilizing wheels, can decisively change the direction of his descent, either to the left or to the right. Having the set of outboard stabilizer wheels angled obliquely forward, the rider can use one of the side wheels to kick or immediately pivot the board for turning to that side.

Figure 3:
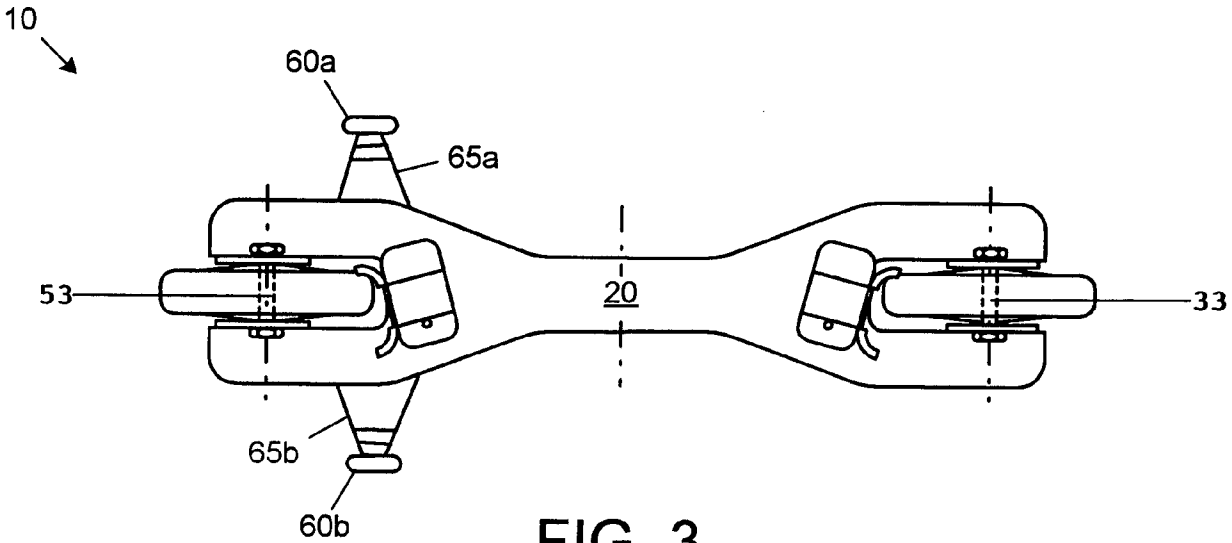
FIG. 3 is a top view of the preferred embodiment of the present invention, showing the outboard stabilizer wheels, positioned parallel to the length of the board and canted outwardly.

By having a set of outboard stabilizer wheels mounted in parallel to the length of the board, (where the axel is orthogonal to the board), as is shown in FIG. 3, the riding-board of the present invention performs more ideally and suitably for downhill riding on a severe downgrade hill or when the rider is confronted by a hill that includes various undulations or irregularities.

Figure 4:
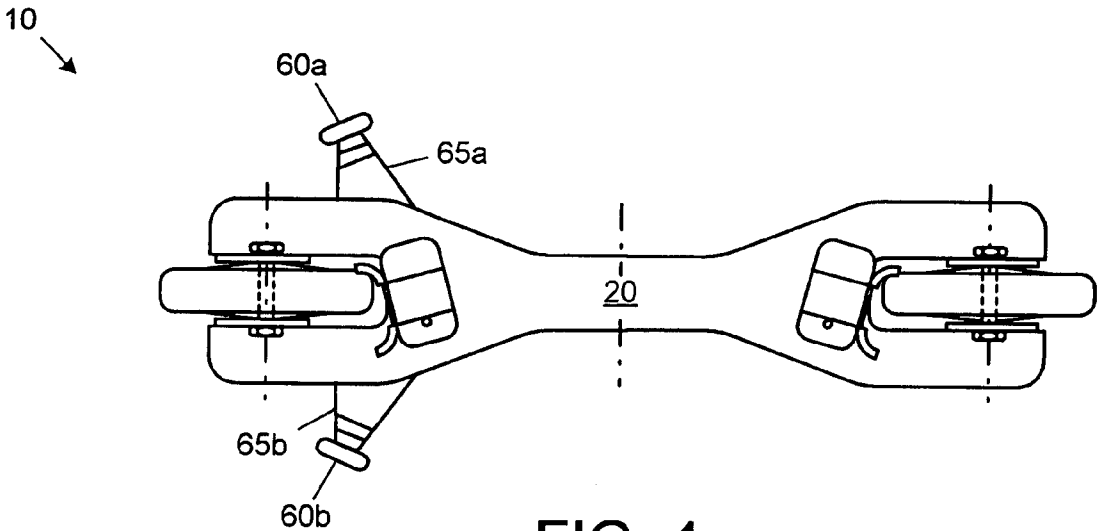
FIG. 4 is a top view of the preferred embodiment of the two-wheeled riding-board, showing the outboard stabilizer wheels, positioned obliquely to the rear and canted outwardly.

With the set of outboard stabilizer wheels angled obliquely to the rear, as is shown in FIG. 4, the riding-board of the present invention performs with greater speed for downhill racing, such as in such cases where the rider does not anticipate doing much turning.

To ride the two-wheeled riding-board, enthusiasts place both feet on the board about shoulder's width apart, so that one foot is in front of the other and the rider is standing sideways. The rider can then choose which foot to place in the front binding 70*a* and which foot to place in the rear binding 70*b*.

The best fitting binding is one where the foot fits snugly into a step-in sleeve 70*a*,70*b* that is mounted to a swiveled breaking platen 75. In an alternative embodiment, Velchro straps with having easy release Bootstraps can also be used.

Each platen 75 is equipped with a curved brakeshoe 80 that when operated by one's foot, applies breaking pressure to the side of the wall of the tire. The platen 75 is secured by pivot point 85 that allows the rider to rotate his foot clockwise to apply the brake to the front wheel and that allows the rider to rotate his foot counterclockwise to release the brake from the front wheel.

The foot independently operated braking system permits the brakes on each wheel to be individually operated—the front wheel may be operated independently by simply rotating ones right foot in a clockwise direction to apply the braking action to the front wheel. Conversely, the rear wheel may also be operated independently by simply rotating ones left foot in a counterclockwise direction to apply braking action to the rear wheel.

In use, the rider can apply only one brake at a time, either the front or rear brake. Or, the rider may apply both brakes simultaneously. The breaking system is best suited on either the asphalt terrain or the dirt path terrain.

Another way to control speed is through having variations in tire pressure. When the tire pressure is low, the rider will experience a slowing down in performance. However, over-inflating the tires will make riding the board unsafe and may even destroy the tires.

Figure 5:
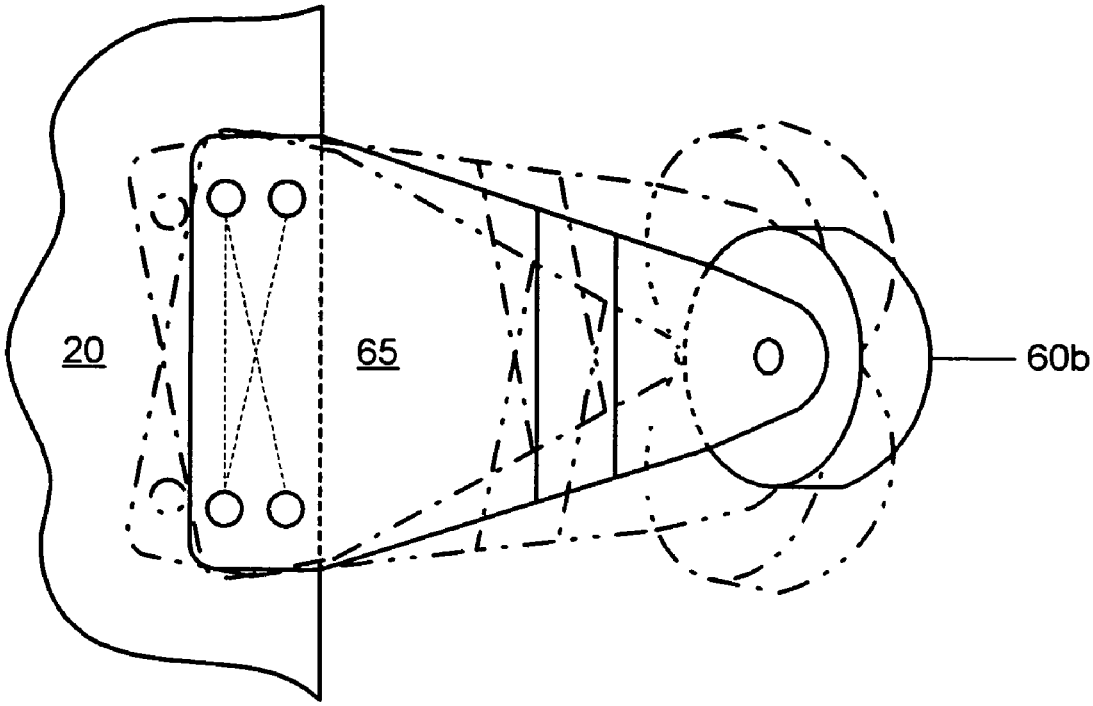
FIG. 5 is a bottom partial view of the preferred embodiment of the two-wheeled riding-board, showing mounting arrangement for the three positions of the outboard stabilizer wheel.
Figure 6:
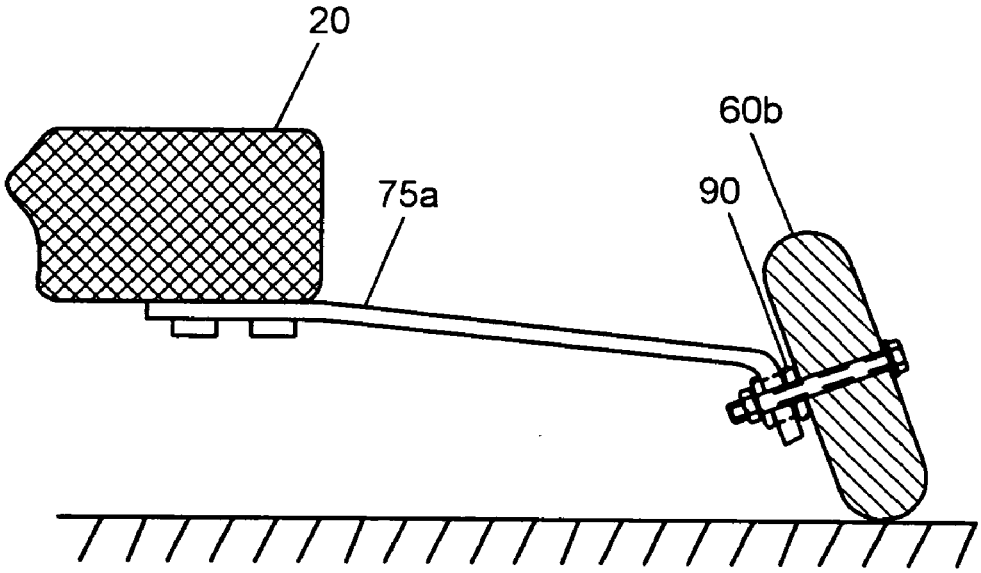
FIG. 6 is a side sectional view of the preferred embodiment of the two-wheeled riding-board, detailing the mounting arrangement for the canted outboard stabilizer wheel, and showing the shock-absorbing bushing.

With reference now to FIG. 5, the stabilizing wheel bracket assembly is shown in the three mounting arrangements; facing forward, facing rear, or parallel to the length of the deck. Four mounting holes in the bracket (each hole enlarged to provide the necessary clearance) are aligned with two holes selected from a plurality of corresponding holes in the underside of the deck. The stabilizing wheel bracket 65 is subsequently mounted and held securely in place using only two wood screws by selecting one from the two front facing holes and one from the two rear facing holes.

Turning now to FIG. 5, there is shown in section, one of the stabilizing wheel brackets 65, secured to underside of deck 20, and having a stabilizer wheel 60 mounted at the end of the bracket. The wheel mounting hole at the end of the bracket is enlarged to permit the insertion of resilient rubber bushing 90. A cap screw then attaches the canted stabilizer wheel 60 to the bracket 65 by passing through the bushing 90. Because of the enlarged clearance hole, the wheel is permitted to perturbate, while still possessing a cushioning quality to provide for improved riding comfort. The stabilizer wheel can perturbate or vibrate in infinite variation on each 360 degree rotation about a longitudinal axis of the cap screw attachment.

Whereas the present invention is described in detail for its particular embodiments, there may be other variations and modifications that will become apparent to those who are skilled in the art upon reading this specification, and that these modifications or variations can be made without detracting from the true spirit of this invention.

What is claimed is:

1. A riding-board comprising:

a deck with head and tail sections, each section having a longitudinal slot with two wheel support brackets mounted oppositely in each side of the slots;

an axel of a spoke wheel with a rim having an elastomeric pneumatic tire mounted on the rim, axially secured on the support brackets of each slot;

the deck including symmetric longitudinal sidecuts with concave narrowed portions near a center of the deck with a consequent increased flexibility of the board;

a pair of stabilizers mounted on the deck near the tail section and projecting radially outward from each side the deck, each stabilizer having a stabilizing bracket and a canted stabilizing wheel mounted on an end of its respective bracket;

wherein each stabilizer bracket is secured on its proximal portion to an underside of the deck and includes a downwardly curved radial end portion having an enlarged mounting hole that receives a resilient rubber bushing which surrounds a cap screw that attaches each canted stabilizing wheel to the bracket.

2. The riding-board as recited in claim 1, wherein the canted wheel perturbates in an infinite variation in its rotation about a longitudinal axis through a center of the bushing.

3. The riding-board as recited in claim 2, further comprising a front rotatable platen positioned near a front wheel and a rear rotatable platen positioned near a rear wheel.

4. The riding-board as recited in claim 3, wherein each platen is mounted to the riding-board on a pivot and each platen includes a curved brakeshoe that upon rotation of the front or rear platen by rotation of a rider's front foot or rear foot, the brakeshoe frictionally contacts its respective nearby wheel to slow or stop the riding-board.

5. The riding-board as recited in claim 4, wherein each platen includes a step-in sleeve for placement of a rider's feet while the rider stands sideways on the riding-board.

6. The riding-board as recited in claim 5, further comprising a stabilizing wheel bracket assembly having three mounting arrangements including a facing forward arrangement, a facing rear arrangement, or an arrangement wherein the wheel bracket is essentially parallel to a lengthwise dimension of the deck.

7. The riding-board as recited in claim 6, wherein two front facing mounting holes and two rear facing mounting holes are drilled through the proximal portion of each bracket for alignment of one front facing mounting hole and one rear facing mounting hole with two holes drilled in the underside of the deck, whereby each stabilizing wheel bracket is held securely in place using two wood screws.

8. The riding-board as recited in claim 7, wherein the step-in sleeve comprises a foot binding constructed of Velcro footstraps for a quick release of the rider's foot.

9. The riding-board as recited in claim 8, wherein the deck is constructed of seven-ply laminated plywood.

10. The riding-board as recited in claim 9, wherein a polyurethane coating is applied over the entire surface of the deck.

11. A riding-board comprising:

a deck suspended on large diameter front and back wheels, each wheel having an axel, the axels in a plane that is parallel with the deck;

a pair of repositionable, outboard stabilizer small diameter wheels, each stabilizer wheel suspended on an opposite side, proximate to a rear portion and radially away from the deck;

wherein a top portion of each stabilizer wheel is canted toward the deck; and each outboard stabilizer wheel provides a maneuvering device wherein a rider, by shifting his body weight over one of the stabilizing wheels can abruptly change direction to the left or to the right;

wherein the deck includes a controllable, individually foot operated, dual actuable braking system, wherein a brake associated with each wheel is independently applied by rotation of a rider's front foot toward the front wheel individually, by rotation of the back foot toward the back wheel individually or rotation of each foot toward a wheel simultaneously, whereby a rider can redirect the riding-board by application of weight on the outboard stabilizer wheels, application of the brakes individually, or together, or by a combination of weight shifting and brake application.

12. The riding-board as recited in claim 11, wherein each of the outboard stabilizer wheels are obliquely angled forward.

13. The riding-board as recited in claim 11, wherein an axel of each of the outboard stabilizer wheels is orthogonal to the board.

14. The riding-board as recited in claim 11, wherein each of the outboard stabilizer wheels is angled toward the rear of the board.

15. The riding-board as recited in claim 11, wherein rotation of each of the outboard stabilizer wheels includes a wobbling motion concurrent with its intermittent contact with a surface under the board.

* * * * *